US006861607B2

(12) United States Patent
Kwong

(10) Patent No.: US 6,861,607 B2
(45) Date of Patent: Mar. 1, 2005

(54) ELECTRICAL SWITCH

(75) Inventor: Yee Tak Kwong, Hong Kong (HK)

(73) Assignee: Defond Components Limited, Chaiwan (HK)

( * ) Notice: Subject to any disclaimer, the term of this patent is extended or adjusted under 35 U.S.C. 154(b) by 0 days.

(21) Appl. No.: 10/615,242

(22) Filed: Jul. 9, 2003

(65) Prior Publication Data

US 2005/0006218 A1 Jan. 13, 2005

(51) Int. Cl.[7] ..... H01H 21/00
(52) U.S. Cl. ..... 200/553; 200/559
(58) Field of Search ..... 200/202, 203, 200/553, 558, 559, 569, 510, 524, 525, 532, 537, 542, 545, 546, 551, 339

(56) References Cited

U.S. PATENT DOCUMENTS 3,670,121 A * 6/1972 Howe ..... 200/446
3,674,966 A * 7/1972 Long ..... 200/557
5,796,058 A * 8/1998 Aimi et al. ..... 200/553
6,005,210 A * 12/1999 Chien ..... 200/339
6,046,414 A * 4/2000 Hirschfeld ..... 200/559
6,066,815 A * 5/2000 Spedale ..... 200/339
6,323,450 B1 * 11/2001 Chen ..... 200/553

* cited by examiner

*Primary Examiner*—Lincoln Donovan
*Assistant Examiner*—M. Fishman
(74) *Attorney, Agent, or Firm*—Leydig, Voit & Mayer, Ltd.

(57) ABSTRACT

An electrical switch comprises a housing, at least one fixed contact and a moving contact assembly provided in the housing, and an actuator. The actuator is supported for movement to move the contact assembly into contact with and out of contact from the fixed contact. The contact assembly comprises at least one pair of pivotable levers, with a first lever arranged to make or break contact with the fixed contact and a second lever pivotable by the actuator to in turn pivot the first lever into contact with the fixed contact.

15 Claims, 2 Drawing Sheets

ELECTRICAL SWITCH

The present invention relates to an electrical switch for, particularly but not exclusively, controlling the operation of an electrical appliance.

BACKGROUND OF THE INVENTION

The moving contact(s) of an electrical switch is sometimes provided by a lever that is electrically conductive for contact making as well as resiliently deformable for movement. These two properties are generally incompatible with each other, and a compromise is often made.

The invention seeks to mitigate or at least alleviate such a shortcoming by providing an improved electrical switch.

SUMMARY OF THE INVENTION

According to the invention, there is provided an electrical switch comprising a housing, at least one fixed contact and a moving contact assembly provided in the housing, and an actuator. The actuator is supported for movement to move the contact assembly into contact with and out of contact from the fixed contact. The contact assembly comprises at least one pair of pivotable levers, with a first lever arranged to make or break contact with the fixed contact and a second lever pivotable by the actuator to in turn pivot the first lever into contact with the fixed contact.

Preferably, the two levers have a multi-layered structure.

Preferably, the two levers are pivotable about substantially the same support.

More preferably, the second lever is mounted on the first lever.

In a preferred embodiment, the two levers are electrically connected together at a common end thereof that acts as a terminal for electrical connection.

In a preferred embodiment, the two levers are electrically conductive and connected together, and are resiliently deformed during operation.

More preferably, the first lever is relatively more electrically conductive and the second lever is relatively resiliently stronger.

Further more preferably, the two levers are made of different materials.

It is preferred that the two levers turn generally through an angle of 90°, and the second lever includes a relatively wide bend for maximum flexibility.

In a preferred construction, the contact assembly includes an additional pivotable lever that is pivotable by the actuator, which lever and the actuator have co-operable parts for selective inter-engagement to define a plurality of stable positions for the actuator.

More preferably, the co-operable parts comprise a series of notches as one part that correspond to the stable positions, whilst the other part is pointed.

More preferably, the electrical switch includes at least two said fixed contacts and corresponding said pairs of first and second levers of the contact assembly, and the additional lever is situated between the two second levers.

Further more preferably, the first levers are provided by an integral multi-pronged contact member, and the second and additional levers are provided by another integral multi-pronged contact member, the two contact members being connected together at a common end thereof.

In a specific example, the actuator comprises a rocker supported for rocking movement to move the contact assembly.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figures 1, 1A, 1B, 1C, 2, 2A, 2B, 2C, 3, 3A, 3B, 3C:
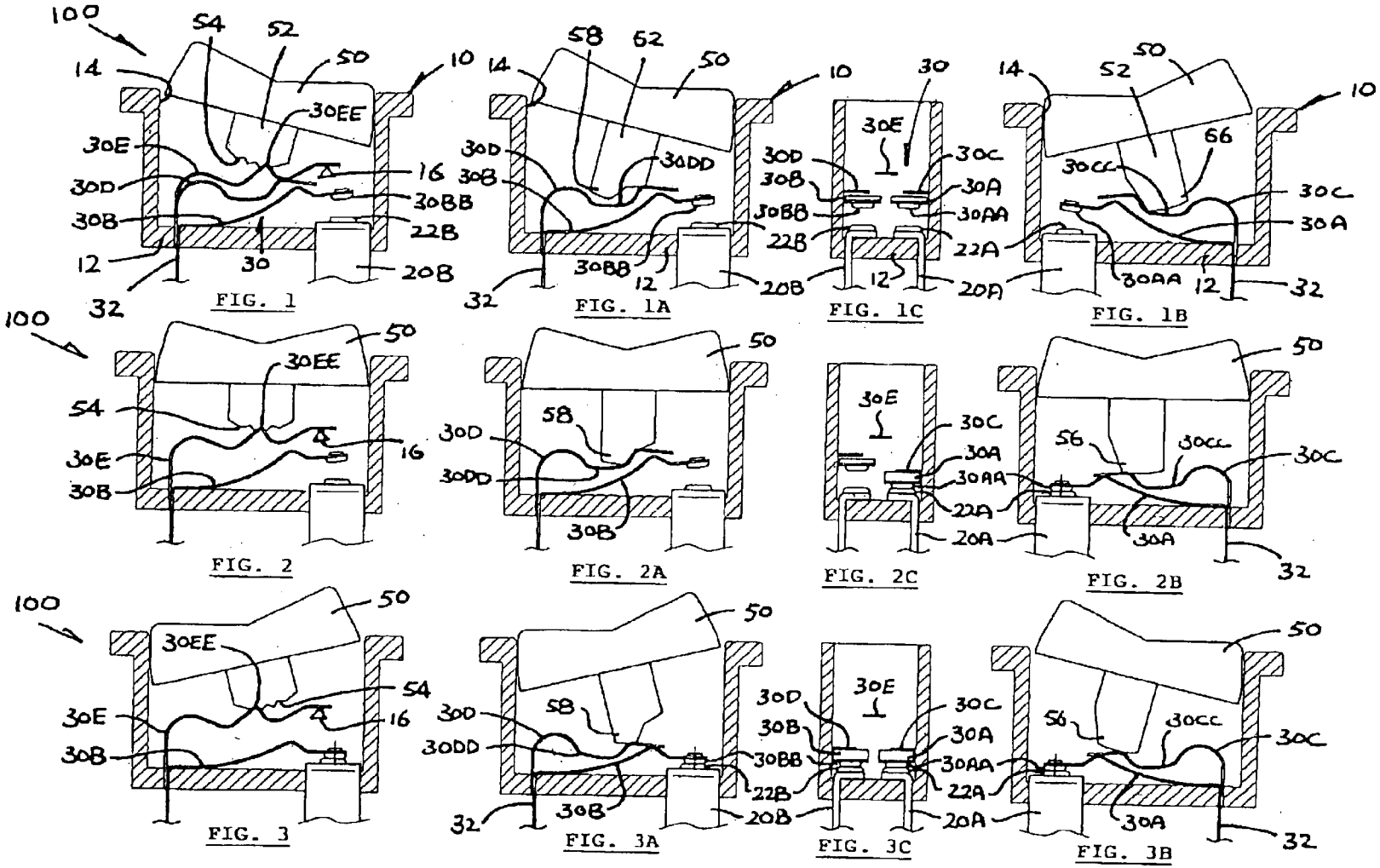
FIG. 1 is a central cross-sectional side view of an embodiment of an electrical switch in accordance with the invention, showing the switch in a switched-off condition, said switch having a moving contact assembly and a rocker for actuating the assembly.
FIG. 1A is a front cross-sectional side view corresponding to FIG. 1.
FIG. 1B is a rear cross-sectional side view corresponding to FIG. 1.
FIG. 1C is cross-sectional end view of the switch of FIG. 1.
FIG. 2 is a central cross-sectional side view of the switch of FIG. 1, showing the switch in a switched-on condition.
FIG. 2A is a front cross-sectional side view corresponding to FIG. 2.
FIG. 2B is a rear cross-sectional side view corresponding to FIG. 2.
FIG. 2C is cross-sectional end view of the switch of FIG. 2.
FIG. 3 is a central cross-sectional side view of the switch of FIG. 1, showing the switch in another switched-on condition.
FIG. 3A is a front cross-sectional side view corresponding to FIG. 3.
FIG. 3B is a rear cross-sectional side view corresponding to FIG. 3.
FIG. 3C is cross-sectional end view of the switch of FIG. 3.
Figure 4:
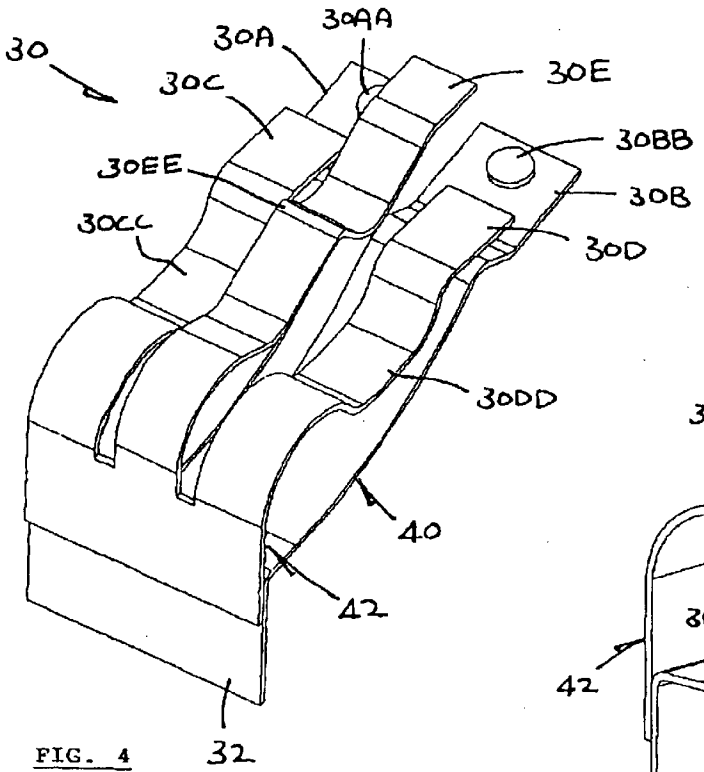
FIG. 4 is a perspective view of the moving contact assembly of FIG. 1.
Figure 5:
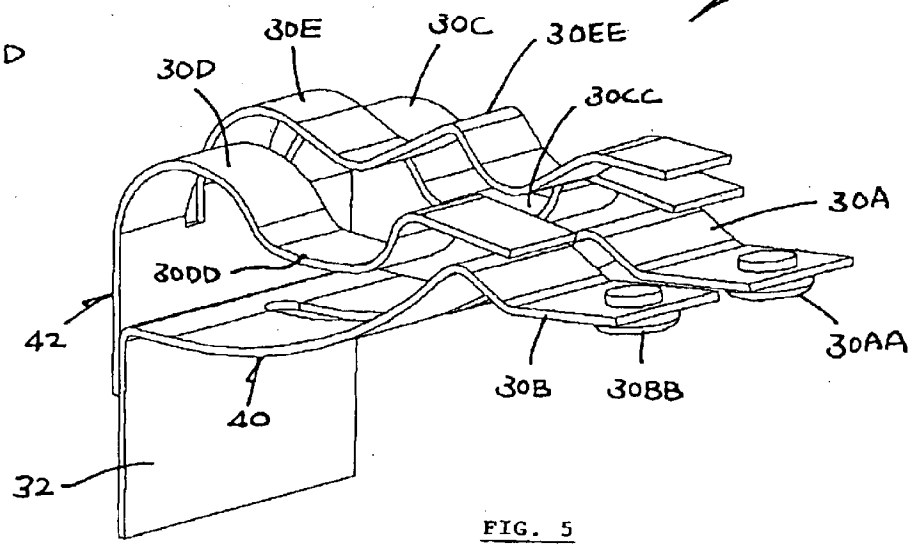
FIG. 5 is another perspective view of the moving contact assembly of FIG. 1.

Referring to the drawings, there is shown an electrical switch 100 embodying the invention, which is a rocker switch 100 having a generally narrow rectangular plastic housing 10, two fixed contact strips 20A and 20B located partially therein and a moving contact assembly 30. The two contact strips 20A and 20B extend downwardly through one end of a horizontal bottom housing wall 12 out of the housing 10, where their lower ends act as individual terminals for connection to a power/load circuit. Their upper ends are folded to lie on the bottom housing wall 12, and are fitted with respective contact pads acting as fixed contacts 22A and 22B.

The contact assembly 30 consists of five contact levers 30A to 30E that stem from a common end or root contact 32 and point in generally the same direction across opposite ends of the housing 10. The root contact 32 extends downwardly through the other end of the bottom housing wall 12 out of the housing 10, where its lower end acts as a "common" terminal for connection to the power/load circuit. The five contact levers 30A to 30E are arranged into a first pair 30A/C on one side of the housing 10, a second pair 30B/D on the opposite side as a mirror image of the first pair 30A/C, and a middle one 30E symmetrically in between.

The contact assembly 30 is formed by an integral bifurcate principal copper strip 40 and an integral trifurcate auxiliary copper strip 42 symmetrically overlying the principal strip 40 to form a multi-layered structure. The two prongs of the principal strip 40 provide the levers 30A and 30B, with its base end providing the root contact 32. The three prongs of the auxiliary strip 42 provide the levers 30C, 30E and 30D, whilst its base end is connected to the upper part of the root contact 32 by spot welding for example, whereby the auxiliary strip 42 is mounted on the principal strip 40.

The lever 30C overhangs the lever 30A to form the first pair 30A/C, which is pivotable about the same support ard is associated with one fixed contact 22A as a first sub-switch (30AA/22A). The lever 30D overhangs the lever 30B to form the second pair 30B/D, which is pivotable about the same support and is associated with the other fixed contact 22B as a second sub-switch (30BB/22B). The middle lever 30E is situated between the levers 30C and 30D, together overlying the other two levers 30A and 30B.

The principal strip 40 is folded through 900 about its base end (the root contact 32) on the upper surface of the housing bottom wall 12, with the levers 30A and 30B inclined gradually upwardly at an angle of about 300. The free ends of the levers 30A and 30B reach immediately above the fixed contacts 22A and 22B respectively, and are fitted with corresponding contact pads acting as moving contacts 30AA and 30BB for making and breaking contact with the fixed contacts 22A and 22B.

The auxiliary strip 42 extends upwardly from the root contact 32, with its levers 30C to 30E then turning to lie generally horizontally through a wide bend over 90°. The wide bend ensures that the levers 30C, 30E and 30D retain maximum flexibility. The two side levers 30C and 30D are cantilevered, having generally the same curved profile that includes a trough 30CC or 30DD at about mid-length. On the contrary, the middle lever 30E is supported at its free end by a stop 16 below it, including an upwardly pointed part 30EE at about mid-length.

The electrical switch 100 includes a plastic actuating rocker 50 which is supported within an open top side of the housing 10 for rocking movement about a transverse horizontal axis. The rocker 50 has a depending stem 52 whose free end bears against the upper levers 30C to 30E, counteracting their inherent resilience.

The free end of the stem 52 has a series of three notches 54. The notches 54 are selectively engageable with or by the pointed part 30EE of the middle lever 30E upon rocking of the rocker 50. By virtue of resilience of the lever 30E, its pointed part 30EE mates with an aligned one of the three notches 54 to define a corresponding stable position of the rocker 50. The rocker 50 thus has a series of three such stable positions, in the first of which the switch 100 is switched off (FIG. 1) and in the other two of which the switch 100 is switched on (FIGS. 2 and 3).

The series of notches 54 lies on a central vertical plane of the rocker 50. The free end of the stem 52 includes two further shaped profiles on opposite sides of the notches 54, which are in the form of relatively broad and narrow legs 56 and 5B. The legs 56 and 58 bear against the contact levers 30C and 30D respectively, engaging about their troughs 30CC and 30DD.

In the switched-off condition of the switch 100 (FIG. 1), the two legs 56 and 58 stay within the troughs 30CC and 30DD (FIGS. 1A and 1B) such that the corresponding levers 30C and 30D and in turn levers 30A and 30B are not pressed down by the rocker 50. Thus, both of the fixed contacts 22A and 22B remain isolated from the corresponding moving contacts 30AA and 30BB (FIG. 1C).

In the first switched-on condition of the switch 100 (FIG. 2), the first rocker leg 56 is pivoted off the respective trough 30CC (FIG. 2B), thereby bending the corresponding lever 30C downwards. The lever 30C in turn presses down the associated lever 30A below it, with the result that the moving contact 30AA makes contact with the fixed contact 22A (FIG. 2C). The other pair of moving and fixed contacts 30B and 22B remains separated, as the other leg 5B is narrower and has not yet come out of the corresponding trough 30DD (FIG. 2A). Thus, only the first sub-switch (30AA/22A) is closed.

The rocker 50 is pivoted In the second switched-on condition of the switch 100 (FIG. 2), the second rocker leg 58 is also pivoted off the respective trough 30DD (FIG. 3A), thereby bending the corresponding lever 30D downwards. The lever 30D in turn presses down the associated lever 30B below it, with the result that the moving contact 30BB makes contact with the fixed contact 22B (FIG. 3C). The first pair of moving and fixed contacts 30AA and 22A keeps in contact, as the first leg 56 remains outside the corresponding trough 30CC (FIG. 3B). Thus, both sub-switches (30AA/22A and 30BB/22B) are closed.

In either pair, for example, the contact levers 30A/30C, the lever 30A is arranged to make or break contact with the corresponding fixed contact 22A and the other lever 30C is pivotable by the rocker 50 to in turn pivot the lever 30A into contact with the contact 22A. Upon rocking of the rocker 50 in the opposite direction, the switch 100 reverses its status by firstly opening its second sub-switch (30BB/22B) and then also its first sub-switch (30AA/22A).

Although the multi-pronged strips 40 and 42 are made of copper, their material compositions are different. The principal strip 40 is made relatively more electrically conductive as its levers 30A and 30B are employed for switching and carrying the load current. On the other hand, the auxiliary strip 42 is made resiliently stronger (of a spring) as its levers 30C and 30D are used to reinforce the contact making levers 30A and 30B, thereby achieving an improved contact pressure (with the fixed contacts 22A and 22B).

It is envisaged that the actuator 50 may be arranged to be slidable relative to the housing 10, in which case the subject switch is a slide switch. The number of fixed and moving contacts is simply a matter of choice, depending on the intended use of the switch.

The invention has been given by way of example only, and various other modifications of and/or alterations to the described embodiment may be made by persons skilled in the art without departing from the scope of the invention as specified in the appended claims.

What is claimed is:

1. An electrical switch comprising a housing, at least one fixed contact and a moving contact assembly provided in the housing, and an actuator supported for movement to move the moving contact assembly into contact with and out of contact from the fixed contact, wherein the moving contact assembly comprises at least one pair of distinct first and second pivotable layers each having a pivoted end portion about which the lever is pivoted and a free end portion, with the first lever arranged to make or break contact by its free end portion with the fixed contact and the second lever pivotable by the actuator to in turn press by its free end portion upon the free end portion of the first lever thereby pivoting the first lever into contact with the fixed contact.

2. The electrical switch as claimed in claim 1, wherein the two levers have a multilayered structure.

3. The electrical switch as claimed in claim 1, wherein the two levers are pivotable about substantially the same support.

4. The electrical switch as claimed in claim 3, wherein the second lever is mounted on the first lever.

5. The electrical switch as claimed in claim 1, wherein the two levers are electrically connected together at a common end thereof that acts as a terminal for electrical connection.

6. The electrical switch as claimed in claim 1, wherein the two levers are electrically conductive and connected together, and are resiliently deformed during operation.

7. The electrical switch as claimed in claim 6, wherein the first lever is more electrically conductive than the second lever.

8. The electrical switch as claimed in claim 7, wherein the two levers are made of different materials.

9. The electrical switch as claimed in claim 6, wherein the two levers each form an angle of about 90°.

10. The electrical switch as claimed in claim 1, wherein the contact assembly includes an additional pivotable lever that is pivotable by the actuator, which lever and the actuator have co-operable parts for selective inter-engagement to define a plurality of positions for the actuator.

11. The electrical switch as claimed in claim 10, wherein the co-operable parts comprise a series of notches as one part that correspond to the stable positions, whilst the other part is pointed.

12. The electrical switch as claimed in claim 10, including at least two said fixed contacts and corresponding said pairs of first and second levers of the contact assembly, wherein the additional lever is situated between the two second levers.

13. The electrical switch as claimed in claim 12, wherein the first levers are provided by an integral multi-pronged contact member, and the second and additional levers are provided by another integral multi-pronged contact member, the two contact members being connected together at a common end thereof.

14. The electrical switch as claimed in claim 1, wherein the actuator comprises a rocker supported for rocking movement to move the contact assembly.

15. An electrical switch comprising a housing, at least two fixed contacts and a moving contact assembly provided in the housing, the moving contact assembly comprising pairs of first and second pivotable levers corresponding to the fixed contacts, and an actuator supported for movement to move the contact assembly into contact with and out of contact from the fixed contacts, the two first levers being arranged to make or break contact with the fixed contacts and the two second levers being pivotable by the actuator to in turn pivot the first levers into contact with the fixed contacts, the contact assembly further including an additional pivotable lever that is pivotable by the actuator, which additional pivotable lever and the actuator have co-operable parts for selective inter-engagement to define a plurality of positions for the actuator, wherein the additional pivotable lever is situated between the two second levers, wherein the first levers are provided by an integral multi-pronged contact member, and the second and additional levers are provided by another integral multi-pronged contact member, the two contact members being connected together at a common end thereof.

* * * * *